US008317633B2

(12) United States Patent
Maclean

(10) Patent No.: US 8,317,633 B2
(45) Date of Patent: Nov. 27, 2012

(54) PUTTING TRAINING METHOD AND APPARATUS

(76) Inventor: Colin Maclean, Parker, CO (US)

( * ) Notice: Subject to any disclaimer, the term of this patent is extended or adjusted under 35 U.S.C. 154(b) by 0 days.

(21) Appl. No.: 13/153,193

(22) Filed: Jun. 3, 2011

(65) Prior Publication Data

US 2012/0196691 A1 Aug. 2, 2012

Related U.S. Application Data

(60) Provisional application No. 61/436,940, filed on Jan. 27, 2011.

(51) Int. Cl.
*A63B 69/36* (2006.01)

(52) U.S. Cl. ..... 473/177; 473/176

(58) Field of Classification Search ..... 473/173–179
See application file for complete search history.

(56) References Cited

U.S. PATENT DOCUMENTS

| | | | | | |
|---|---|---|---|---|---|
| 1,402,026 | A | * | 1/1922 | Waddell | 473/177 |
| 1,673,852 | A | * | 6/1928 | Underwood et al. | 473/177 |
| 1,826,641 | A | * | 10/1931 | Waddell | 473/177 |
| 1,829,283 | A | * | 10/1931 | Kip | 473/177 |
| 2,041,119 | A | * | 5/1936 | Duganne | 473/176 |
| 3,180,644 | A | * | 4/1965 | Winquist | 473/177 |
| 3,790,166 | A | * | 2/1974 | Hamilton et al. | 473/177 |
| 4,273,329 | A | * | 6/1981 | Trigg et al. | 473/407 |
| 5,393,053 | A | * | 2/1995 | Wiese et al. | 473/177 |
| 5,480,142 | A | * | 1/1996 | Ackerman | 473/178 |
| 7,815,530 | B2 | * | 10/2010 | Cannata | 473/407 |

* cited by examiner

*Primary Examiner* — Mark Graham
(74) *Attorney, Agent, or Firm* — Jessica L. Olson; Oppedahl Patent Law Firm LLC

(57) ABSTRACT

The apparatus and methods of the current invention utilize a device that is secured within a golf hole and comprises a series of tethers and or aiming rods as well as a ball retrieving mechanism. The purpose of the invention is to improve the user's putting ability.

36 Claims, 5 Drawing Sheets

PUTTING TRAINING METHOD AND APPARATUS

CROSS REFERENCE TO RELATED APPLICATIONS

This application claims the benefit of U.S. Provisional Application No. 61/436,940, filed Jan. 27, 2011, which is incorporated by reference herein for all purposes.

BACKGROUND

Four-putting for a double bogey after being on the green in two can lead to a very frustrating game of golf. This is especially true if the first putt was within six feet of the hole. Successful putting includes being able to read the green as well as being able to gauge the distance to the hole and control the speed of the ball.

The apparatus and method of the current invention is a tool designed to help teach the golfer how to read the breaks of the green as well as to improve line-of-sight to the cup.

SUMMARY

The following embodiments and aspects thereof are described and illustrated in conjunction with systems, tool and methods which are meant to be exemplary and illustrative, not limiting in scope.

The apparatus and methods of the current invention utilize a device that is secured within a golf hole and comprises a series of tethers and/or aiming rods as well as a ball retrieving mechanism. The purpose of the invention is to improve the user's putting ability.

One embodiment of the current invention is designed to be mounted within a golf hole and is supported by a weight, which may be cylindrical, and is inserted into the standard flag holder portion of the golf hole's cup. This exemplary embodiment further contains two circular plates, a top plate and a bottom plate, each attached to a separate rod. The plates are substantially parallel to each other and the rods that extend from them are also substantially parallel to each other. The top plate remains above the golf hole. The bottom plate rests within the hole and its surface area substantially covers the bottom of the cup. The purpose of the bottom plate is to capture successfully putted golf balls for later extraction. The balls may then be extracted all at once by pulling up the bottom plate. The top plate has holes in a circular pattern radiating out from a center point. Exemplary embodiments include eight or twelve holes radially arranged around the center of the top plate, however, a larger or smaller number of holes may be appropriate as well. The holes in the top plate are provided to allow a place for a cord reel or common "badge reel" to be attached to the top plate. Each cord reel (or reels) contains a tether. Although other lengths are also possible, exemplary lengths of tethers are approximately three feet and approximately six feet. When extended, the three foot and six foot tethers are meant to indicate three foot and six foot putting distances. Optionally, a single tether may be marked to indicate various lengths, thus allowing the user to select a length without having to change out the cord reel to practice a putt from a particular distance. A spike or other anchor mechanism is mounted on the end of each tether to secure the end of the tether that is extended away from the cord reel into the green.

Further to what is described above, one exemplary embodiment of the apparatus of the invention may be used to indicate the distance from the hole (cup placement on a golf green) in three foot and six foot predetermined lengths by utilizing eight cord or badge reels containing tethers of exemplary predetermined lengths of three and six feet, or with markings indicating lengths which include three and six feet. A tether is extended from each cord reel. On the end of each tether is a small spike. The spikes are stuck into the green radially around a hole, marking out eight points around the cup. The eight points that the tethers extend from may be thought to represent the cardinals of a compass. The golfer then places a golf ball adjacent to or a pre-determined distance from a first spike to begin putting.

The radially positioned tethers may be used for at least the following:

- aiding the golfer in developing line-of-sight from the golf ball to the hole,
- aiding the golfer in learning how to read the green by viewing a tether parallel to the ground to better illustrate the changes in the contour of the green as the distance between the tether and the ground varies with the contours, and
- providing a positioning system to assist the golfer who may want to track and keep a history of putting results for later analysis.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
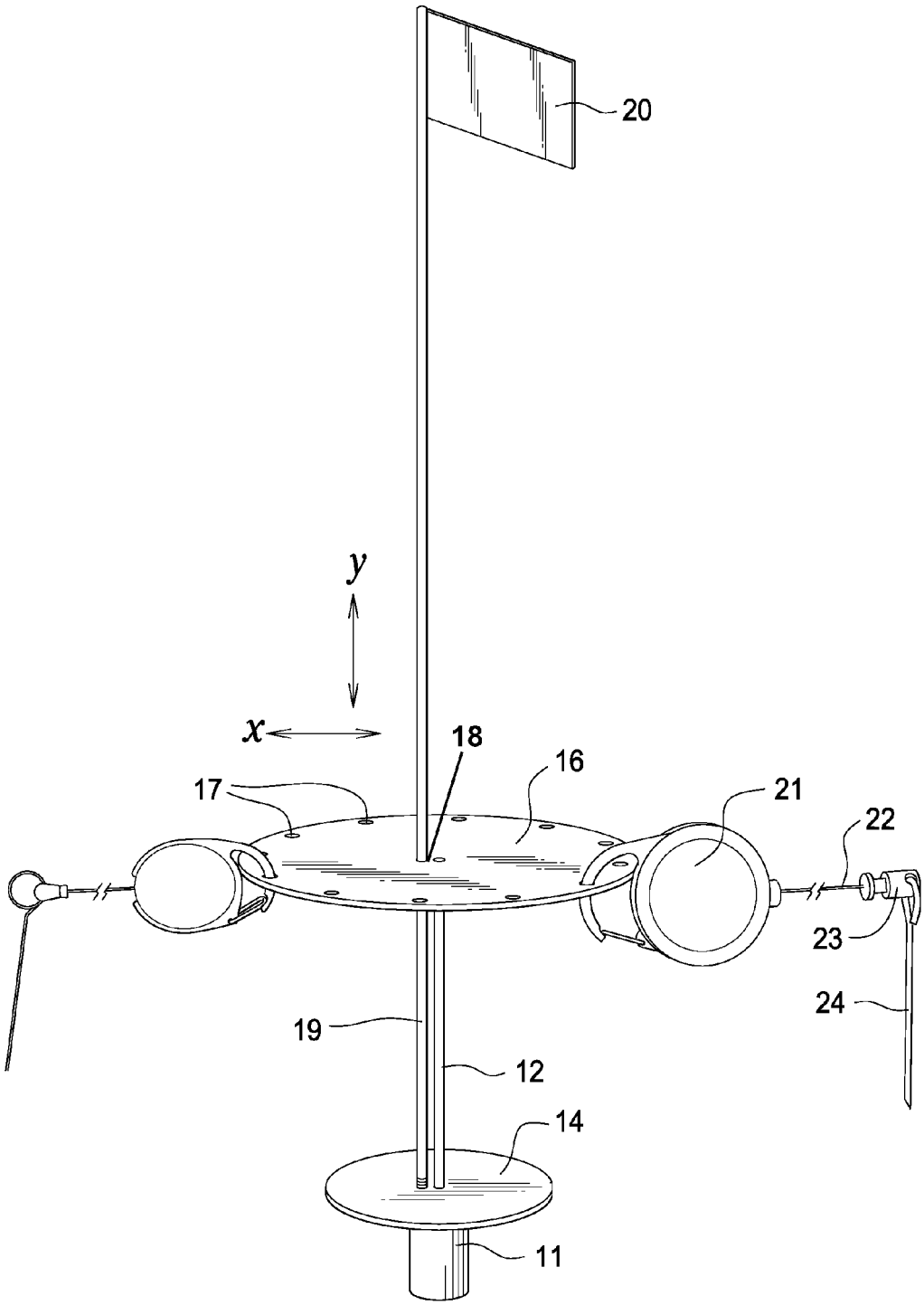
FIG. 1 is an illustration of an embodiment of the apparatus of the invention.

One embodiment of the apparatus of the invention is illustrated by FIGS. 1-5 and comprises:

a weight 11 sized to fit into a golf hole or to be secured by the flag holder portion 29 of a golf cup, said weight 11 attached to a first rod 12, the weight 11 may or may not be cylindrical in shape, but as those skilled in the art will appreciate may be other shapes as well such as but not limited to triangular, square, octagonal, or hexagonal as long as it supports the apparatus within the hole;

said first rod 12 extending through a first opening 13 cut through a bottom plate 14;

said bottom plate 14 shaped to be placed within a golf hole and designed to substantially cover the surface area of the bottom of the golf hole in such a way that any gap between any portion of the side edge 15 of the golf hole and the bottom plate 14 is smaller than the diameter of a standard sized golf ball;

said first rod 12 attached to a top plate 16, said top plate 16 having a plurality of holes 17 arranged in a circular pattern radially around a center area, the center area being the location of where first rod 12 is attached to top plate 16 and said center area further comprising a second opening 18;

said bottom plate 14 attached to a second rod 19, said second rod 19 extending through second opening 18, said second rod 19 having a first end and a second end, wherein said second end of the second rod 19 optionally has a flag-like topper 20 attached, wherein said first end of the second rod is attached to the bottom plate 14;

wherein said first rod 12 and said second rod 19 are substantially parallel to each other along a y-axis and the first and second openings are large enough to allow the second rod to slide along the y-axis; and at least one cord reel 21 attached to top plate 16 by attaching it to at least one of the plurality of holes 17, said cord reel 21 comprising a tether 22 which may be extended and retracted from the cord reel 21, said tether 22 having a length, the length of the tether 22 not limited to, but optionally being three feet or six feet, said tether 22 having a first end which resides within the cord reel 21 and a second end 23 opposite the end within the cord reel, said second end attached to a spike 24, said spike or other anchor designed to be stuck into the surface of the green 30 to prevent the tether 22 from being retracted back into the cord reel 21.

In another embodiment, the invention comprises a weight 11 with a top side and a bottom side, a top plate 16 with a top side and a bottom side, and a first rod 12 extending between the bottom side of the top plate 16 and the top side of the weight 11. The invention further comprises a bottom plate 14 slidely mounted on the first rod 12 between the bottom side of the top plate 16 and the top side of the weight 11. The terms "slidely mounted" are intended to mean secured in a way that allows the bottom plate 14 to move freely along the length of the first rod 12 between the top plate 16 and the weight 11. The bottom plate 14 has a top side and a bottom side. The invention further comprises a second rod 19, a portion of which extends between the top side of the bottom plate 14 and the bottom of the top plate 16. The second rod 19 may also extend above the top plate 16 in such a way that it is secured by the top plate, but is allowed to move freely through the top plate. The second rod 19 is attached to the top side of the bottom plate 14 and may be used to slide the bottom plate 14 to a chosen location on the first rod 12. For example, a user could grasp a portion of second rod 19 and lift upwards. Doing so would raise the bottom plate 14. If, at the time, the device was mounted inside of a golf hole, raising the bottom plate 14 with the second rod 19 would allow the user to extract golf balls that were hit into the hole without having to remove the entire device to do so. The weight 11 would remain in the hole to support the rest of the device. This embodiment of the invention could also include one or more of the following components: holes 17 and 28 in the top plate 16, positioned radially around a center point; stationary or retractable tethers 22; cord reels 21 attached to the holes 17 (or possibly 28) in the top plate to attach the tethers 22; spikes 24 or other anchors for the tethers 22; flags 20 or other decorative toppers 20 attached to the end of the second rod 19 that was not attached to the bottom plate 14; a third rod 25, which may or may not be telescoping, to be used for additional aiming purposes; a threaded or unthreaded mounting mechanism or post 26 to support a connection of the second rod 19 to the bottom plate 14; and a score card to track use of the device or to indicate a specific training exercise to be used with the device prior to its use. Additional descriptions of the components are provided throughout the application and are not meant to be limited to a particular exemplary embodiment of the invention.

An exemplary method for using the apparatus of the invention includes the following steps:

1. Place the weight 11 attached to rod 12 into the flag holder portion of the bottom of the cup. It may be placed in a similar fashion to the placement of a typical flag stick.
2. Extend each of the tethers to its desired length from the cord reels and secure with the spike into the surface of the green. This may be the tether's full length or a shorter length that may or may not be indicated on the tether itself.
3. Place at least one ball next/adjacent to at least one spike.
4. Utilize the tether to improve line-of-sight (a.k.a. "aim") toward the hole. Visually study the variances in the distance between the surface of the green and the tether to aid in determining the contours of the green.
5. Practice putting the desired amount of practice putts from balls placed at each of the spikes/anchors.
6. Record and/or analyze the results.
7. Retrieve the balls from the hole by pulling up on rod 19 or the flag-like topper 20 mounted on the top of rod 19. This allows the golfer to continue to practice without having to attempt to reach between top plate 16 and the golf hole, or be required to remove the tethers 22 to retrieve the balls.

Additional steps may include assembling the apparatus. For example, rod 19 may need to be mounted, perhaps by screwing a threaded end directly into bottom plate 14. Rod 19 may be attached to the bottom plate 14 with a specific coupling. Rod 19 may be mounted by screwing a threaded end into coupling comprising a threaded support post 26 attached to plate 14. Rod 12 may also have one or more threaded ends that could be screwed into top plate 16 and/or weight 11. Other means of connecting the rods and plates may be utilized as well. For example, plate 16 may also have a threaded support post similar to support post 26 for attaching rod 12. It is also possible for a support post mounted on plate 14 or 16 to not be threaded.

Additional steps may also include connecting at least one cord reel 21 to at least one of the plurality of holes 17. For example, eight cord reels may be connected to eight holes positioned similarly to cardinals of a compass. In another example, twelve cord reels may be connected to twelve holes positioned similarly to numerals on a clock face. In yet another example, 24 cord reels may be connected to 24 holes positioned every 15 degrees of a circle. It is not necessary for the number of cord reels 21 in use to equal the number of holes 17.

The length of all of the tethers 22 utilized may be the same or substantially similar, or the length of some or all of the tethers 22 may be different. The lengths of the tethers 22 may alternate in a pattern between each of the holes 17. In one embodiment, a first reel 21 may have a tether that is three feet and the two additional reels mounted in the holes to either side of the first reel 21, may have tethers of six feet. Optionally, the tethers 22 of all cord reels on one side of top plate 16 may be of one length, for example three feet, and the tethers of all cord reels on the other side of top plate 16 may be a second length, for example six feet. The various ways of mixing cord reels with different lengths of tethers allow the golfer to vary the putting distance during one session of use of the training device simply but putting from a different tether spike location.

Additional embodiments of the invention may include but are not limited to the following to those described below.

The top plate 16 may be larger than the bottom plate 14. The top plate 16 may be circular or disk shaped. The top plate 16 may also be other shapes such as a square, triangle, hexagon, or other polygon. Regardless of the shape of top plate 16, it is preferred that the holes 17 are positioned to form a circular shape at positions radiating from a center portion of the top plate.

The holes radially positioned from a center point on top plate 16 may number, for example, 8, 12, 16, 24, 36, and 64 holes. More or less holes are possible as well depending on the area available on the top plate 16 to drill the holes and the number of tethers desired.

It should be appreciated that another optional embodiment of the invention is to permanently bond cord reels or static tethers to the top plate 16. This may negate the need for the holes. However, the permanently mounted reels or static tethers would still need to be positioned at various radials around a center point to form a circle. It should be noted, that as long as the radials extend from the same center point located on the top plate 16, the holes or permanently affixed tethers or cord reels need not form an even circle. The radials at which each of the holes is positioned may be of different lengths from the center area. As described above, permanently mounted cord reels may also number, for example 8, 12, 16, 24, 36, and 64 reels positioned radially around a center point. More or less reels are possible as well depending on the area available on the top plate 16 and the number of tethers 24 desired.

Rod 19 does not require a flag-like apparatus 20 to be mounted on one end. For example, a different shaped "topper" may be utilized instead. For example, a ball instead of a flag-like apparatus may be mounted at the end of rod 19. Alternatively, the rod may simply end without an additional item attached to its end.

As mentioned previously, weight 11 need not be cylindrical in shape.

Exemplary materials used for construction of the apparatus of the invention may include but not be limited to various metals or plastics.

The length of rod 12 between the top plate 16 and the cylinder 11 should be sufficient to allow a putted golf ball to pass under the top plate 16 and into the hole.

As described above and as appreciated by those skilled in the art, embodiments of the invention may include being provided with multiple lengths of tethers, for example, but not limited to one being approximately three foot and one being approximately six foot premeasured lengths.

Optionally, lengths of pre-measured cord could be provided as an alternative method for extending spikes from the wheel/top plate 16 (the cord would not have to be recoiling like the tether contained a badge reel—the cord could be static) to stick into the green's putting surface. Exemplary lengths of these cords, and/or retractable tethers, may range from one inch to 100 feet. One could also utilize a cord/tether comprising an elastic-like material which could be stretched from plate 16 and secured to the green with an anchor.

Alternative designs for the top plate 16 may also include altering the circular hole placement. One embodiment of the top plate 16 may have twelve holes 17 around its edge with the same face/place indicators/hole locations as a clock—1 through 12. This pattern:

1. enables the ability to add 33% more coverage around the cup than the eight hole example—by adding four more hole locations, and
2. enables the user to have more detailed breakdown of the breaks/undulations and straight lines into the cup.

Figure 2:
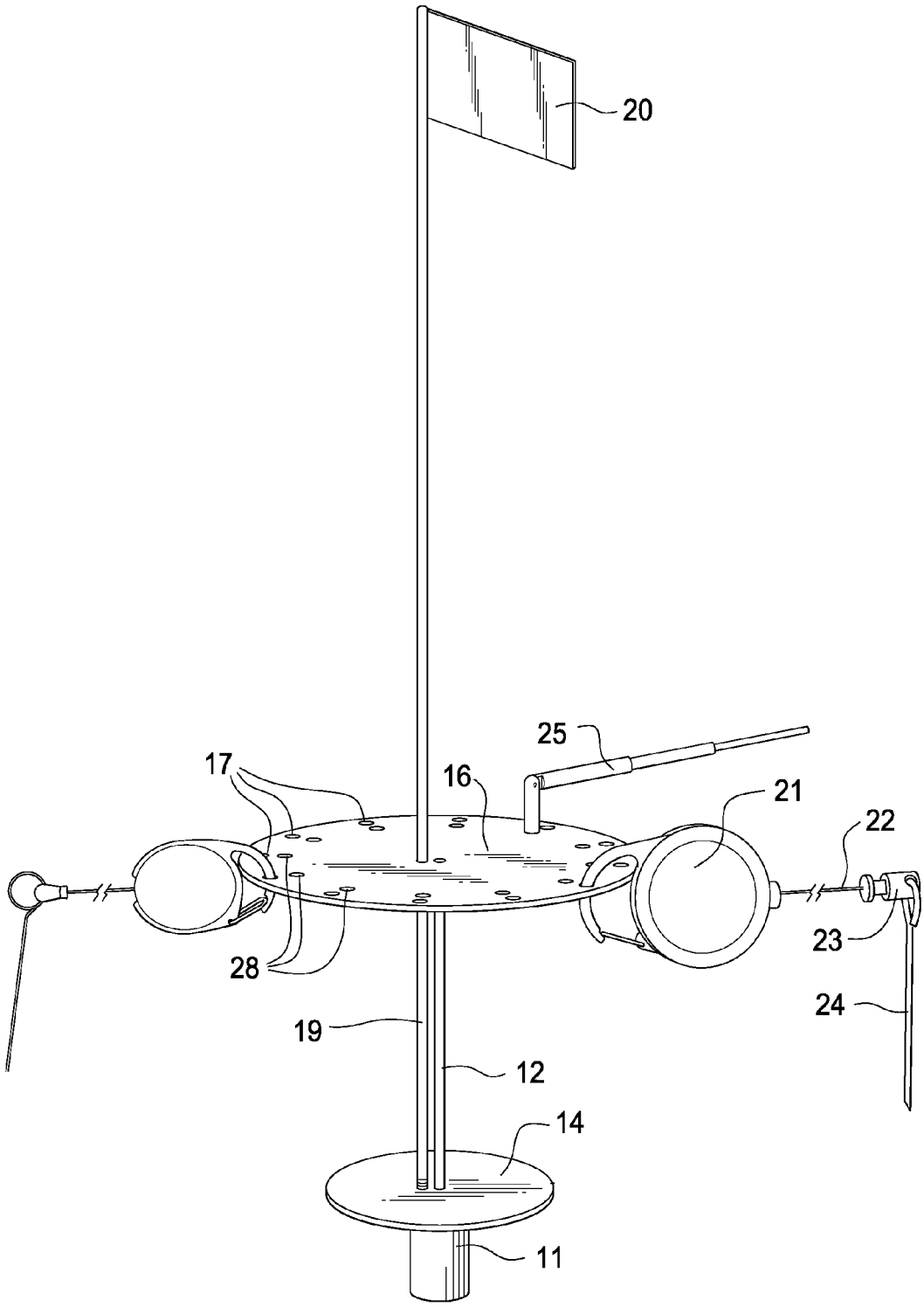
FIG. 2 is an illustration of an embodiment of the apparatus of the invention, showing an optional second plurality of holes 28 on plate 16 and optional telescoping pointer 25.
Figure 3:
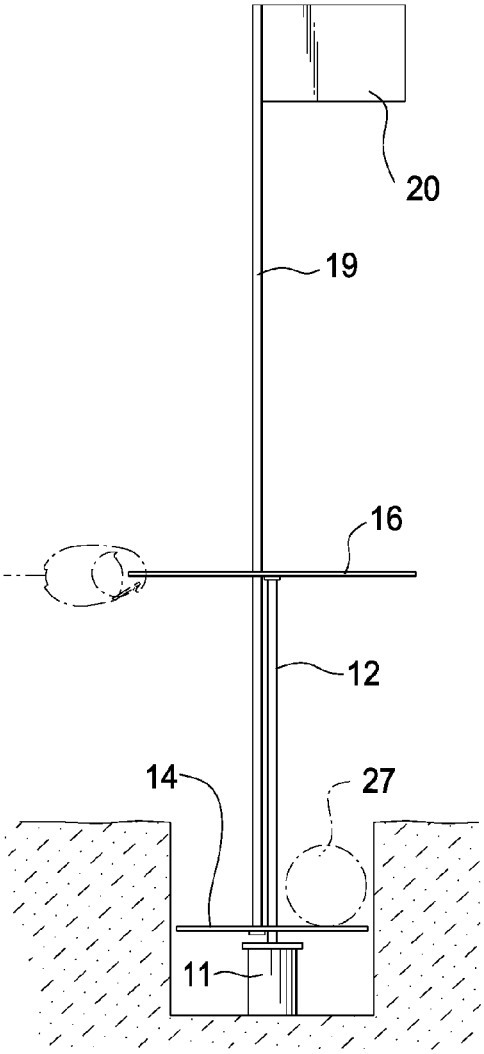
FIG. 3 is an illustration of an embodiment of the apparatus of the invention placed within a golf hole.
Figure 4:
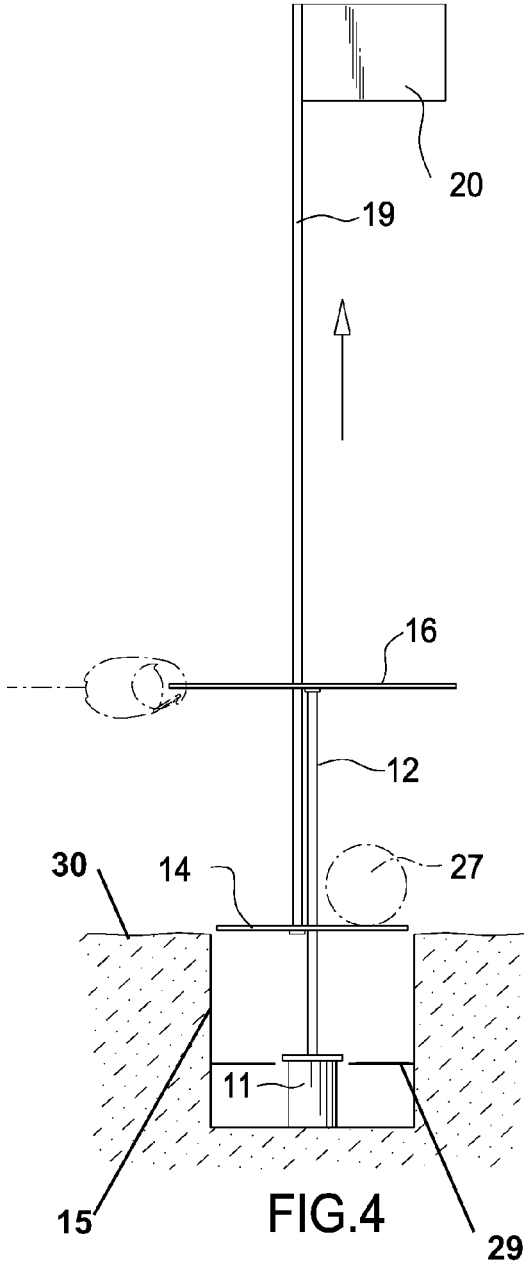
FIG. 4 is an illustration of an embodiment of the apparatus of the invention placed within a golf hole and also showing flag holder topper 20.
Figure 5:
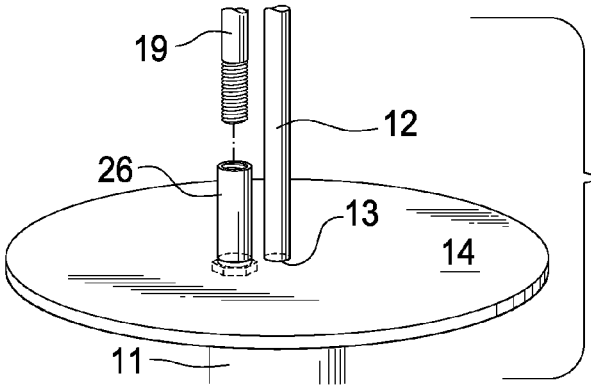
FIG. 5 is an illustration of an embodiment of the apparatus of the invention showing a exemplary means for attaching plate 14 to rod 19.
Figure 6:
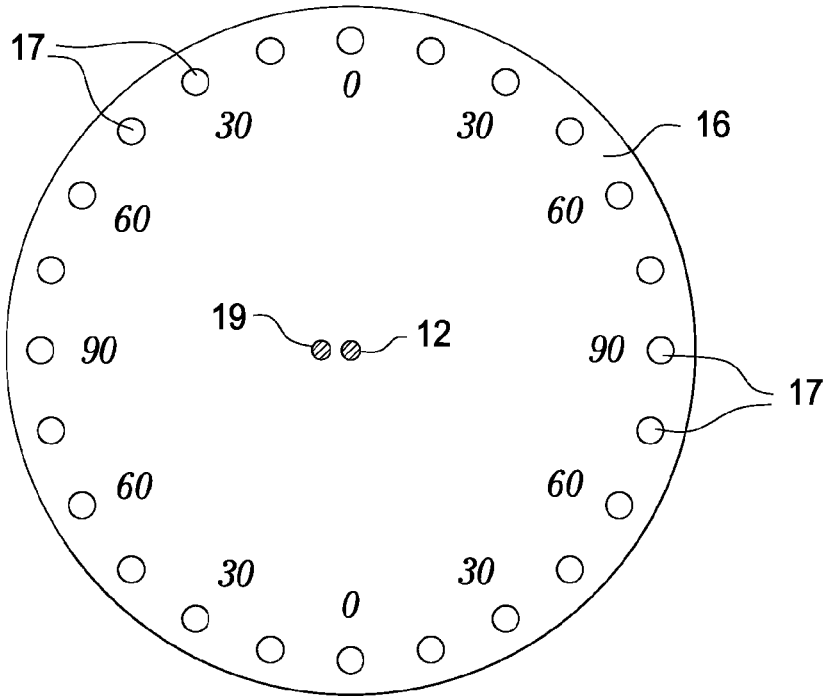
FIG. 6 is an illustration of an exemplary embodiment of plate 16.
Figure 7:
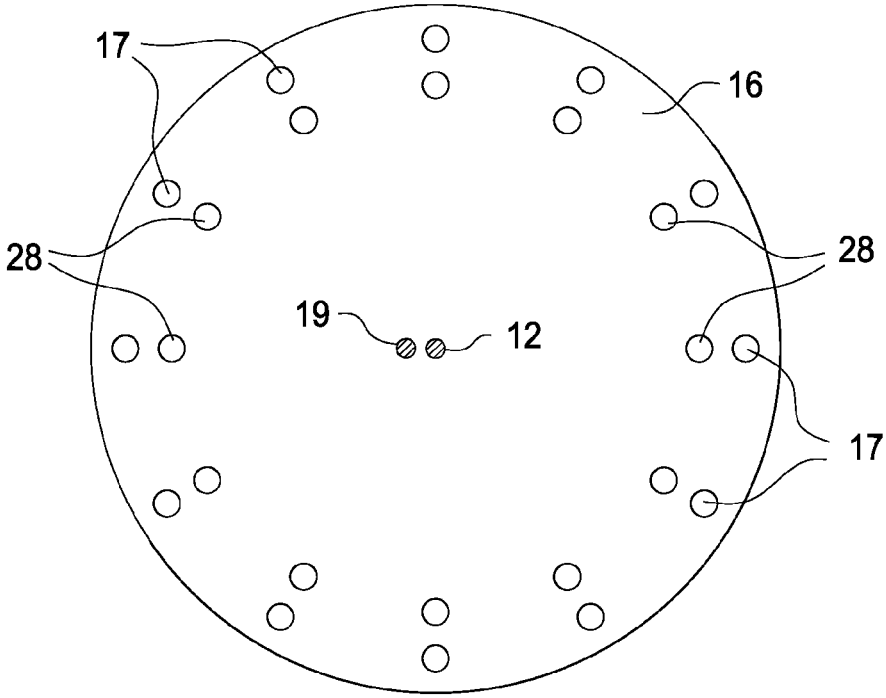
FIG. 7 is an illustration of an exemplary embodiment of plate 16 showing a first and second plurality positioned radially around a center area.

FIG. 7 shows a twelve-hole configuration with an additional optional embodiment of having a second set of holes 28 positioned along the same radial line as each of the holes 17. The second set of holes allow the insertion of a telescoping (or non-telescoping) rod that measures from approximately six inches to 36 inches (or any length in between) and is affixed into at least one of the secondary holes. An additional option is to include inches and indicators on the rod. One purpose for incorporating the additional rod into this device is to encourage the golfer to aim at the rod instead of along the tether. Eventually the tether could be removed, allowing the rod to remain. An exemplary telescoping rod 25 is shown in the embodiment illustrated by FIG. 2. FIG. 2 also illustrates an example of the second plurality of holes along the same radial lines as the first plurality of holes. It should also be appreciated that cords of predetermined length that may or may not have a recoil system (such as the cord or badge reels) can be utilized with this "double-hole" configuration. The static lines may range from approximately 1 inch to 100 feet.

The methods of use of embodiments of the apparatus having a first and a second plurality of holes in the top plate 16, positioned at clock positions, would be similar to the other embodiments described above but also would add more granularity for the breakdown of the area around the cup, thus enabling more accurate reading of the cup on the green including:

a) illustration of a straight line from the cup (or ball to the cup) from 12 different locations,
b) creation of a more detailed circle around the cup—showing/detailing the breaks and undulations around the cup with regard to its placement on the green,
c) by using the cord/tether as an assistant to determine the sloping of the green users can now target more easily where they will putt the ball,
d) by using the telescoping or static (predetermined length) rod as an assistant to determine the sloping of the green, users can now target where they will putt the ball (determining the best path to role the ball on to get into the cup) with or without the tethers.

Figure 8:
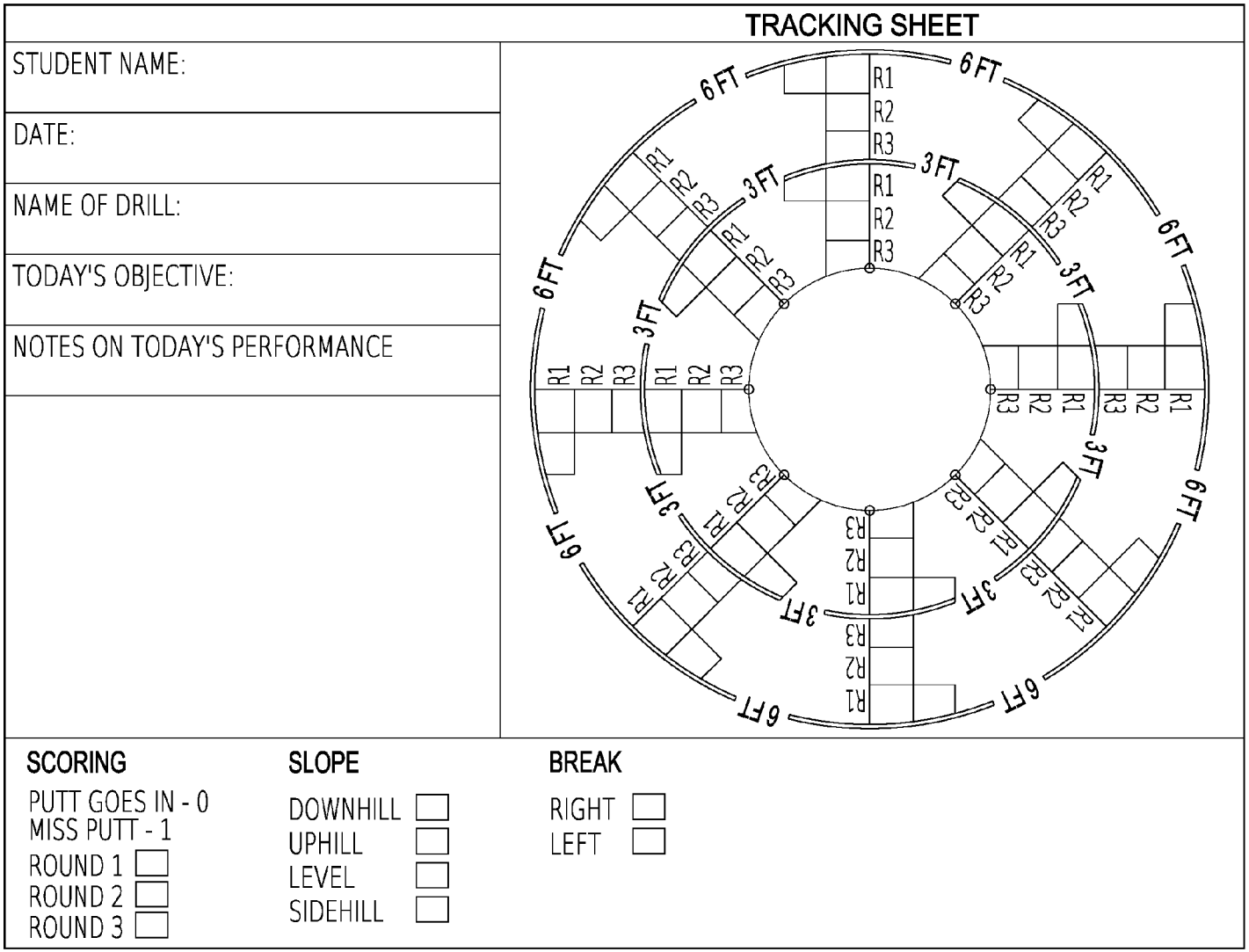
FIG. 8 is an illustration of an exemplary tracking card to be utilized with the methods of the invention.

An illustration of an exemplary card used to track the results of the golfer's putting practice while utilizing an embodiment of the apparatus of the current invention is shown in FIG. 8. It should be understood that other appropriate tracking sheets could be easily developed and utilized as well.

The following describes a method of utilizing the tracking sheet shown in FIG. 8 with eight tethers extending from every 45° around the top plate.

1. Place the weight 11 attached to rod 12 into the flag holder portion of the bottom of the cup. It may be placed in a similar fashion to the placement of a typical flag stick.

2. Connect and extend at least one, but more than likely all eight tethers positioned 45° apart on the top plate 16 to its desired length from the cord reels 21 and secure with the spike 22 into the surface of the green (in this particular embodiment, extended to 6 feet or 3 feet as indicated on the card of FIG. 8.

3. Place at least one ball adjacent to or within a predetermined distance from at least one spike.

4. Utilize the tether to improve line-of-sight (a.k.a. "aim") toward the hole. Study the variances in the distance between the surface of the green and the tether to aid in determining the contours of the green.

5. Putt

6. The chart shown in FIG. 8 corresponds to the tether's position on the plate where the user putted from, i.e. the distance from the hole. Indicate in the corresponding boxes the position of the ball or balls. For example, if the first shot was from 6 feet from the hole at the 12:00 position, record this by marking an x or some other similar mark in the box to the far left of the R1 located just under the 6 FT line on the card. If the putt goes into the hole, enter a 0 in the box immediately next to the R1 located just under the 6 FT line on the card. If the ball does not go into the hole, enter a 1 in the box immediately next to the R1 located just under the 6 FT line on the card.

7. Continue putting at each of the tether locations that correspond to the positions on the card of FIG. 8. Indicate the distance from the hole and whether the putt goes in as each practice shot is taken. Once a putt has been taken at a particular location, record the results of the next putt at that location in the box immediately below the first result, as indicated by the R2 box. The object in scoring is to accumulate the lowest score and this particular embodiment of the tracking sheet is set up to perform three rotations around the unit (8×3=24 putts). It should be appreciated that similar tracking sheets could be created to capture results from practicing putting from, for example, 8, 12, 16, 24, 36, and 64 hole positions depending on the number and placement of the tethers. It may be that the sheet would need to become larger to accommodate a larger number of tether positions. It also is possible that the tracking sheet be made electronic or be utilized as an Application on a hand held electronic device or a Smart Phone.

8. Once the putting drill is over, add together the results for each of the distances. If you shot an 8 from the 3 foot distance on 24 putts, that would be poor as that would be only 66% accurate; PGA tour pros record above 92% accuracy from the 3 foot distance. However, if you shot an 8 from the 6 foot distance, this would be excellent. PGA tour pros shoot under 60% accuracy on putts at the 6 foot distance.

A score card similar to that shown in FIG. 8 could be used to set up practice drills prior to putting practice. In this case, either the golfer or perhaps the golfer's coach would pre-fill in the box on the far left of R1 at each position representing a tether location to indicate if the user should attempt a six foot or three foot putt while working through the drills.

Various patterns could be used to further personalize a training session. For example, cards could be pre-filled to indicate in the box of the far left of R1 that all putts should be taken at six feet, or pre-filled in to indicate that all putts should be taken at three feet. Alternatively, the putting distance could alternate from six feet to three feet every hole. Another option would be to have all three foot putts on one side of the hole and all six foot puts on the other side of the hole. Another use of the pre-filled score sheet would be to indicate where to putt the ball from when there are less tethers than position indictors to fill in on the card. For example, a 12 position card could be used to indicate 8 positions to actually putt from. A user might also choose to move the tethers after practicing at one particular distance to the other distance. In this way, it would be possible to putt and record results until the card is completely full.

Utilizing the apparatus of the invention, the user may be able to record 48 quality putts in 10 minutes. Accuracy can be tracked over days, months, or years. It also should be noted that the tracking sheet shown in FIG. 8 allows you a place to record what type of slope you are on and the direction of that slope, the totals of each Round also can be recorded as well as how the green breaks. After each tracking sheet is filled out to the user or coach's satisfaction, the information may also be entered, or in the case of an electronic tracking sheet imported, into a spreadsheet for further analysis or accumulation of data for trending over time.

Many embodiments of the invention share the same general features. The device fits in the cup on a green. The device can be set up in under 60 seconds and torn down in less than 30 seconds. The user can putt from either beside or underneath a cord/tether. Multiple patterns and multiple distances may be set up and interchanged for various training experiences.

It should be noted that the flag topper or other topper is not solely ornamental. If one pulls up on the topper or even simply on rod 19 causing the bottom plate to lift, the golf balls eventually will come up out of the cup as the bottom plate continues to rise. This is an important facet to performing the drill, since one object of the invention is to keep the tempo up and the golfer engaged. By not needing to stop and pull the balls out of the cup individually, it quickens the pace and keeps the golfer focused.

While a number of exemplary aspects and embodiments have been discussed above, those of skill in the art will recognize certain modifications, permutations, additions and sub-combinations therefore. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

The invention claimed is:

1. An apparatus for use with putting comprising:

a weight, said weight sized to fit into a golf hole, said weight having a top and a bottom;

a first rod, said first rod having a first end and a second end, said first end attached to the top of the weight;

a bottom plate, said bottom plate comprising:

a top side, a bottom side, a first opening, wherein the bottom plate is shaped to be placed within a golf hole and sized to substantially cover the surface area of a bottom of a golf hole, wherein the first opening is sized to allow the first rod to move freely through it, wherein the first opening is also sized to prevent the weight from moving through it;

a second rod, said second rod having a first end and a second end, said first end attached to the top side of the bottom plate;

a top plate, said top plate comprising:

a top side, a bottom side, a first plurality of holes arranged in a circular pattern radially around a center area, said center area comprising a second opening, wherein said second opening is sized to allow the second rod to move freely through it;

wherein the bottom side of the top plate is attached to the second end of the first rod;

a first tether, said tether coupled to one of the first plurality of holes of the top plate;

wherein the bottom plate is positioned between and may move between the top of the weight and the bottom of the top plate.

2. The apparatus of claim 1 further comprising:

a first coupling attached to the top side of the bottom plate, wherein the first end of the second rod is attached to the top side of the bottom plate by the first coupling.

3. The apparatus of claim 2 wherein the coupling is a threaded post and wherein the first end of the second rod is threaded.

4. The apparatus of claim 1 wherein the weight is sized to fit within the flag holder portion of a golf cup.

5. The apparatus of claim 1 wherein the top plate comprises a second plurality of holes arranged radially around the center area and positioned closer to the center area than the first plurality of holes.

6. The apparatus of claim 5 further comprising a third rod having a first end and a second end, said first end positioned within a first hole of the second plurality of holes in the top plate.

7. The apparatus of claim 6 wherein the third rod is a telescoping rod having an elbow bend allowing a portion of the third rod extending between the elbow bend and the second end to be in a position substantially parallel to the top side of the top plate.

8. The apparatus of claim 1 wherein the tether is coupled to one of the first plurality of holes of the top plate by a cord reel, wherein the tether has a first end and a second end, said first end attached to the cord reel and said second end extendable from the cord reel to a predetermined distance, said second end of the tether attached to an anchor for keeping the tether in position after being extended from the cord reel.

9. The apparatus of claim 8 wherein the anchor attached to the second end of the tether is a spike designed to be stuck into a surface of the green to prevent the tether from being retracted back into the cord reel.

10. The apparatus of claim 1 further comprising a topper attached to the second end of the second rod.

11. The apparatus of claim 10 wherein the topper is a flag.

12. The apparatus of claim 1 wherein the first plurality of holes arranged in a circular pattern radially around a center area are eight holes positioned radially at substantially equal distances from each other, approximately 15 degrees apart.

13. The apparatus of claim 1 wherein the first plurality of holes arranged in a circular pattern radially around a center area are twelve holes positioned radially at substantially equal distances from each other, at twelve clock positions.

14. The apparatus of claim 1 wherein a pre-determined quantity of first plurality of holes arranged in a circular pattern radially around a center area are selected from the group consisting of 8, 12, 16, 24, 36, or 64 holes.

15. The apparatus of claim 1 wherein all holes of the first plurality of holes are positioned radially from the center area at substantially equivalent distances from the center area.

16. The apparatus of claim 14 wherein all holes of the first plurality of holes are positioned radially from the center area at substantially equivalent distances from the center area.

17. The apparatus of claim 14 wherein at least two of the holes of the first plurality of holes are positioned radially from the center area at non-equal distances from the center area.

18. The apparatus of claim 3 further comprising:

a topper attached to the second end of the second rod;

wherein the weight is sized to fit within the flag holder portion of the golf cup, wherein the tether is coupled to one of the first plurality of holes of the top plate by a cord reel, and wherein the tether has a first end and a second end, said first end attached to the cord reel and said second end extendable from the cord reel to a predetermined distance, said second end of the tether attached to a spike for keeping the tether in position after being extended from the cord reel.

19. An apparatus for use in a putting hole comprising:

a weight having a top side and a bottom side;

a top plate having a top side and a bottom side;

a first rod extending between the bottom side of the top plate and the top side of the weight;

a bottom plate slidely mounted on the first rod between the bottom side of the first plate and the weight, said bottom plate having a top side and a bottom side;

a second rod extending between the top side of the bottom plate and the bottom of the top plate;

wherein the second rod attached to the top side of the bottom plate allows a user to slide the bottom plate to a chosen location on the first rod.

20. The apparatus of claim 19 further comprising:

a first plurality of holes arranged in a circular pattern radially around a center area of the top plate, said center area comprising a second opening allowing the second rod to move freely through it and to extend above the top of the top plate;

a first tether, said tether coupled to one of the first plurality of holes of the top plate;

wherein the weight is sized to fit into a golf hole, wherein the bottom plate is shaped to be placed within a golf hole and sized to substantially cover the surface area of a bottom of a golf hole.

21. A method for practicing putting comprising the steps of:

placing a first golf ball adjacent to a second end of a first tether, said first tether extending a predetermined distance from and having a first end coupled to a first hole of a first plurality of holes arranged in a circular pattern radially around a center area of a top plate, said top plate comprising a top side, a bottom side, a second opening sized to allow a second rod to move freely through it, said bottom of the top plate attached to a second end of a first rod, said first rod also having a first end, said first end of the first rod attached to a top of a weight, said weight sized to fit and is positioned within a golf hole, said second rod having a first end and a second end, said first end of the second rod attached to a top side of a bottom plate, said bottom plate also comprising a bottom side and a first opening, wherein the bottom plate is shaped to be placed and is placed within a golf hole and sized to substantially cover the surface area of a bottom of a golf hole, wherein the first opening of the bottom plate is sized to allow the first rod to move freely though it, wherein the bottom plate is positioned between and may move between the top of the weight and the bottom of the top plate;

visually utilizing the first tether to evaluate the line of sight to the golf hole and the slope of the green between the first golf ball and the golf hole;

putting the first golf ball towards the golf hole.

22. The method of claim 21 wherein the first golf ball putted towards the hole goes into the hole, and further comprising the step of:

raising the bottom plate with the first rod until the first golf ball is extracted from the hole.

23. The method of claim 21 further comprising the step of:

indicating on a tracking sheet whether or not the first golf ball went into the golf hole.

24. The method of claim 21 further comprising the step of:

indicating on the tracking sheet a starting position of the first golf ball.

25. The method of claim 21 further comprising the steps of:

placing a second golf ball adjacent to the second end of the first tether;

visually utilizing the first tether to evaluate the line of sight to the golf hole and the slope of the green between the second golf ball and the golf hole;

putting the second golf ball towards the golf hole.

26. The method of claim 21 further comprising the steps of:

placing a second golf ball adjacent to a second end of a second tether, said second tether extending a predetermined distance from and having a first end coupled to a second hole of the first plurality of holes arranged in a circular pattern radially around a center area of the top plate;

visually utilizing the tether to evaluate the line of sight to the golf hole and the slope of the green between the second golf ball and the golf hole;

putting the second golf ball towards the golf hole.

27. The method of claim 21 wherein the first end of the first tether is coupled to one of the first plurality of holes of the top plate by a cord reel, wherein the second end of the first tether is attached to an anchor for keeping the tether in position after being extended from the cord reel.

28. The method of claim 27 wherein the anchor attached to the second end of the tether is a spike.

29. The method of claim 21 wherein the first tether extends a predetermined distance of about three feet from the first hole of the first plurality of holes.

30. The method of claim 21 wherein the first tether extends a predetermined distance of about six feet from the first hole of the first plurality of holes.

31. The method of claim 26 wherein the predetermined distance that the first tether extends from the first hole of the first plurality of holes is the same predetermined distance that the second tether extends from the second hole of the first plurality of holes.

32. The method of claim 26 wherein the predetermined distance that the first tether extends from the first hole of the first plurality of holes is different than the predetermined distance that the second tether extends from the second hole of the first plurality of holes.

33. The method of claim 26 further comprising the step of:

indicating on a tracking sheet whether or not the second golf ball went into the golf hole.

34. The method of claim 26 further comprising the step of:

indicating on the tracking sheet a starting position of the second golf ball.

35. The apparatus of claim 1 wherein the tether comprises a static cord.

36. The apparatus of claim 20 wherein the tether comprises a static cord.

* * * * *